US005505441A

United States Patent [19]

Sugiyama et al.

[11] Patent Number: 5,505,441

[45] Date of Patent: Apr. 9, 1996

[54] PAPER CONVEYING APPARATUS FOR SHEET-FED PRESS

[75] Inventors: Hiroyuki Sugiyama; Kyotaro Onuma, both of Ibaragi, Japan

[73] Assignee: Komori Corporation, Tokyo, Japan

[21] Appl. No.: 284,905

[22] Filed: Aug. 2, 1994

[30] Foreign Application Priority Data

Aug. 12, 1993 [JP] Japan ..... 5-219216

[51] Int. Cl.[6] ..... B65H 5/12

[52] U.S. Cl. ..... 271/268; 271/85

[58] Field of Search ..... 271/268, 267, 271/84, 85; 101/408–410

[56] References Cited

U.S. PATENT DOCUMENTS 2,776,136 1/1957 Dietrich ..... 271/268
2,875,693 3/1959 Jergrell ..... 271/268 X

FOREIGN PATENT DOCUMENTS 0372237 11/1989 European Pat. Off. ..... B41F 21/05
769277 4/1955 United Kingdom ..... B41F 27/05

*Primary Examiner*—David H. Bollinger
*Attorney, Agent, or Firm*—Blakely, Sokoloff, Taylor & Zafman

[57] ABSTRACT

A paper conveying apparatus for a sheet-fed press includes a shaft, a gripper shaft, a plurality of grippers, a gripper pad, levers, a rod, a slide member, rollers, and cam plates. The shaft has two ends pivotally supported by a pair of frames. The gripper shaft extends parallel to the shaft and swings upon pivotal movement of the shaft. The plurality of grippers are aligned on the gripper shaft. The gripper pad extends to be parallel to the gripper shaft and swings upon pivotal movement of the shaft. The grippers and the gripper pad grip the end portion of a sheet conveyed from upstream a paper conveying direction by cooperation thereof, and convey the sheet to a cylinder downstream the paper conveying direction. The levers, the rod, the slide member, the rollers, and the cam plates reciprocally move in the axial direction of the shaft to flex the central portions of the gripper pad and gripper shaft in the paper conveying direction.

10 Claims, 3 Drawing Sheets

PAPER CONVEYING APPARATUS FOR SHEET-FED PRESS

BACKGROUND OF THE INVENTION

The present invention relates to a paper conveying apparatus of a sheet-fed press, which grips, with conveying grippers, the end portion of a sheet conveyed from upstream in the paper conveying direction and supplies the sheet to a printing cylinder.

Generally, in a paper conveying apparatus of this type, sheets are drawn and conveyed by suction one by one by the suction port of a sucker unit from a paper feed unit. Each sheet is then fed onto a feeder board by rotation of a paper feed roller, and conveyed on the feeder board toward a feed board by a paper feed tape or the like. When the sheet is fed onto the feed board, its leading end is aligned by a registration portion, and the sheet is gripped by, e.g., the grippers of a swingable swing unit. Then, the sheet is conveyed to the cylinder of the printing press by the pivotal movement of the swing unit, and re-gripped by the grippers of the cylinder.

In the paper conveying apparatus of this type, the trailing side of the paper expands or shrinks in the right-to-left direction due to water and a large pressure which are applied when the sheet is subjected to printing. When this expansion or shrinkage occurs, misregistration occurs in printing registration called fan-out registration at the trailing side of the paper during multi-color printing, to cause defective printing.

SUMMARY OF THE INVENTION

It is an object of the present invention to provide a paper conveying apparatus for a sheet-fed press, in which fan-out registration is corrected to improve its precision.

It is another object of the present invention to provide a paper conveying apparatus for a sheet-fed press in which fan-out registration can be adjusted even during operation of the printing press.

In order to achieve the above objects, according to the present invention, there is provided a paper conveying apparatus for a sheet-fed press, comprising a shaft having two ends pivotally supported by a pair of frames, a gripper shaft which extends parallel to the shaft and swings upon pivotal movement of the shaft, a plurality of grippers aligned on the gripper shaft, a gripper pad which extends to be parallel to the gripper shaft and swings upon pivotal movement of the shaft, the grippers and the gripper pad gripping an end portion of a sheet, which is conveyed from upstream a paper conveying direction, by cooperation thereof and conveying the sheet to a cylinder downstream the paper conveying direction, and displacing means which reciprocally moves in an axial direction of the shaft to flex central portions of the gripper pad and the gripper shaft in the paper conveying direction.

DESCRIPTION OF THE PREFERRED EMBODIMENTS

Figure 1:
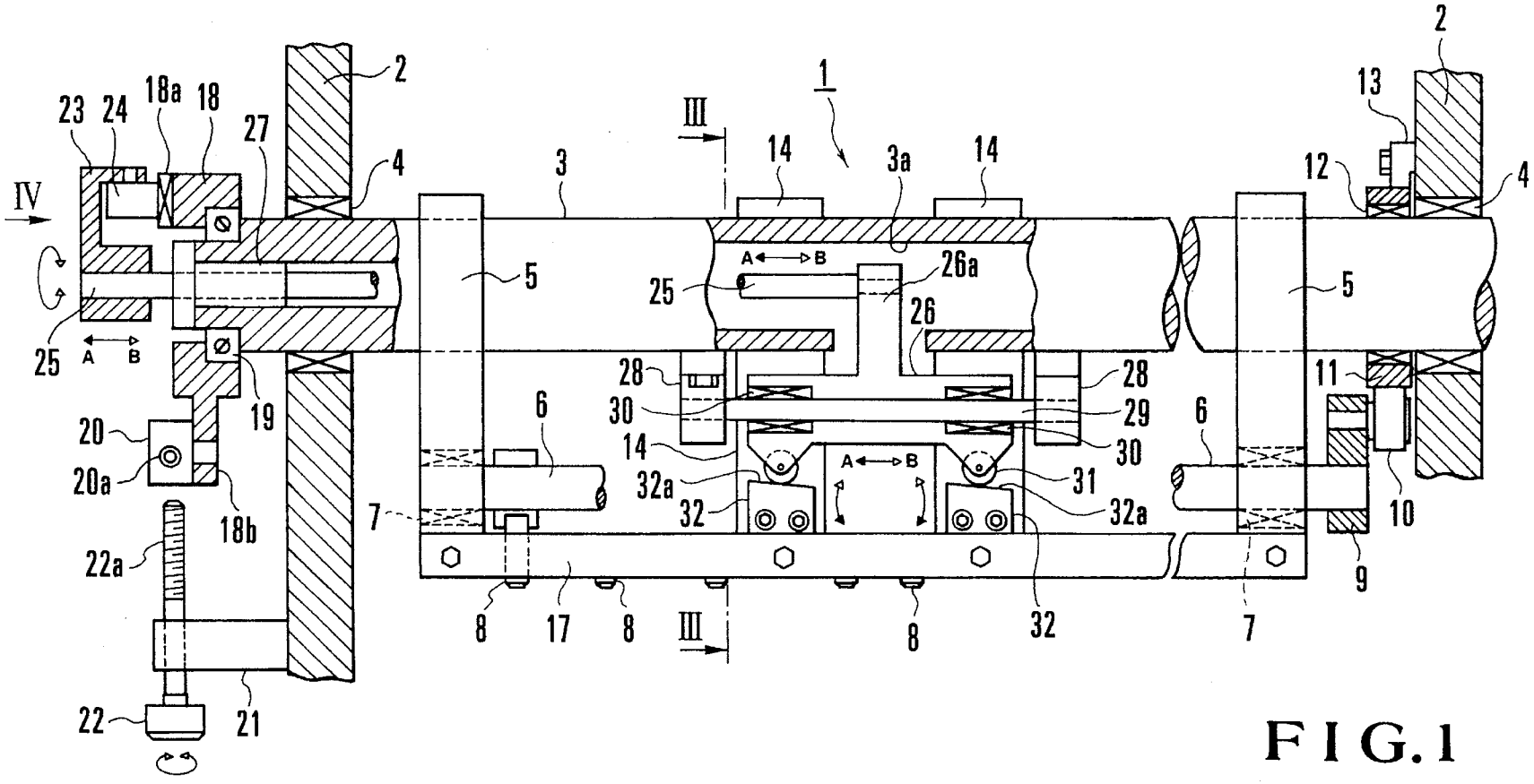
FIG. 1 is a partially sectional side view showing a paper conveying apparatus for a sheet-fed press according to the first embodiment of the present invention.
Figure 3:
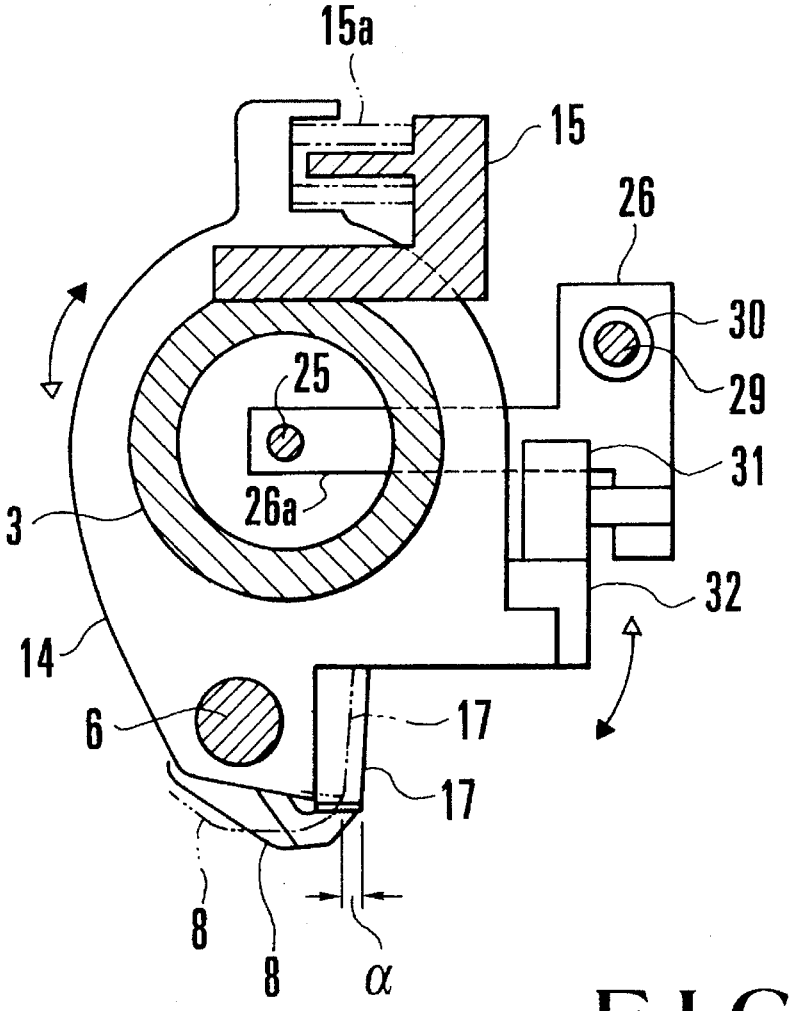
FIG. 3 is a sectional view taken along the line III—III of FIG. 1.
Figure 4A:
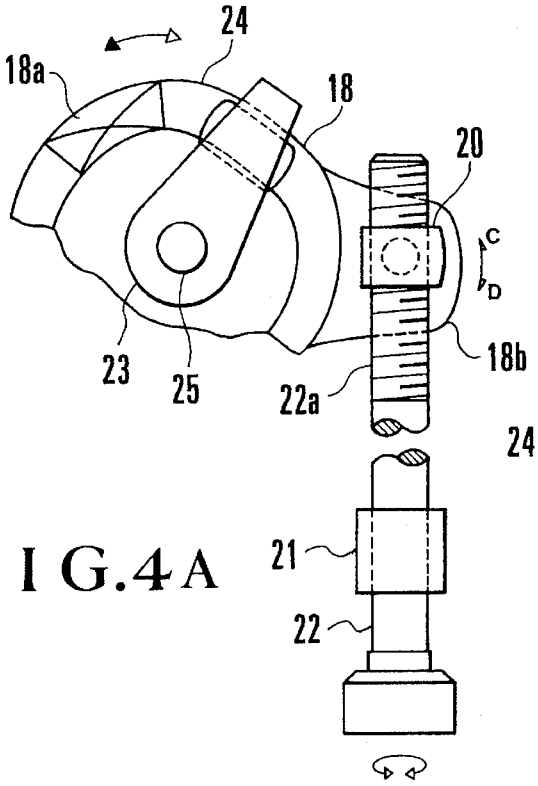
FIG. 4A is a view seen along an arrow IV of FIG. 1.
Figure 4B:
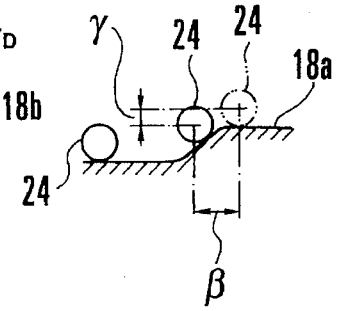
FIG. 4B is a view explaining the relationship between an end face cam portion and a roller.
Figure 5:
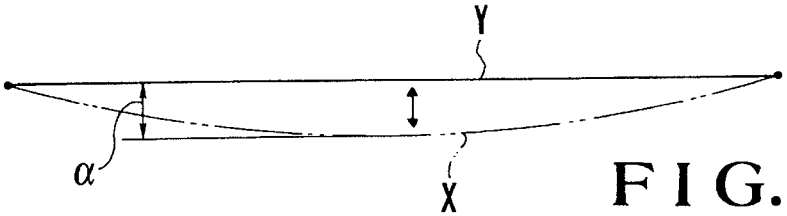
FIG. 5 is a view showing the gripper alignment position of the paper conveying apparatus shown in FIG. 1 in cases wherein paper is gripped and re-gripped.

The preferred embodiments of the present invention will be described with reference to the accompanying drawings. FIG. 1 shows a paper conveying apparatus of a sheet-fed press according to the present invention, FIG. 2 explains the paper conveying operation of the paper conveying apparatus shown in FIG. 1, FIG. 3 shows the paper conveying apparatus taken along the line III—III of FIG. 1, FIG. 4A shows the apparatus seen along an arrow IV of FIG. 1, FIG. 4B explains the relationship between an end face cam portion and a roller, and FIG. 5 shows the gripper alignment position in cases wherein paper is gripped and re-gripped. Referring to FIG. 1, a swing unit entirely denoted by reference numeral 1 serves as the paper conveying apparatus for the sheet-fed press. Two ends of a cylindrical swing shaft 3 having a hollow portion 3*a* are pivotally supported by a pair of frames 2, arranged parallel to each other with a predetermined gap, through bearings 4.

The swing shaft 3 supported by the frames 2 is reciprocally pivoted by a motor (not shown) as a drive source through a known cam and a known link mechanism. A pair of support levers 5 are fixed such that their upper end sides oppose the swing shaft 3. A gripper shaft 6 having two ends pivotally supported through bearings 7 extends between the lower end sides of the support levers 5 to be parallel to the swing shaft 3 and a gripper pad 17 (to be described later). Grippers 8 are fixed to the gripper shaft 6 and provided at a plurality of portions of the gripper shaft 6 at predetermined gaps therebetween. A lever 9 has one end fixed to one projecting end of the gripper shaft 6. A roller 10 is pivotally supported by the other end of the lever 9. A cam 11 is abutted by the roller 10. The cam 11 is pivotally supported by the swing shaft 3 through a bearing 12, and is fixed to one frame 2 with a bracket 13.

Levers 14 serve as a pair of support members opposing each other at a predetermined gap. As shown in FIG. 3, the upper end sides of the levers 14 are pivotally supported by the swing shaft 3. The gripper shaft 6 is inserted in the lower end sides of the levers 14. The levers 14 are disposed at substantially the central portion between the two support levers 5. The levers 14 are pivoted counterclockwise by compression springs 15*a*, which are interposed between the levers 14 and brackets 15 fixed at the upper end of the swing shaft 3, about the swing shaft 3 in FIG. 3 as the center, so that cam plates 32 (to be described later) are abutted against rollers 31. A gripper pad 17 extends between the two support levers 5 to be parallel to the swing shaft 3 and is mounted to the lower ends of the support levers 5 and the levers 14. A cam member 18 is rotatably supported, through a bearing 19, by the stepped projecting end portion of the end side of the swing shaft 3 opposite to the side where the cam 11 is supported. An end face cam portion 18*a* is provided to part of the end face of the cam member 18 to project in a direction parallel to the direction of thickness, i.e., parallel to the swing shaft 3. A block 20 having a female thread portion 20*a* is mounted to a tongue portion 18*b* formed at the lower end side of the cam member 18. An adjustment knob 22 is axially supported by a bracket 21 fixed to the corresponding frame 2. A male thread portion 22*a* threadably engageable with the female thread portion 20*a* of the block 20 is formed at the distal end portion of the adjustment knob 22.

A lever 23 is abutted against the end face of the cam member 18 and pivotally supports a roller 24 facing the end face cam portion 18*a*. The lever 23 is fixed to one end of a rod 25 disposed in the hollow portion 3*a* of the swing shaft 3. The other end of the rod 25 is fitted and fixed in the hole of a projecting portion 26*a* of a slide member 26 (to be described later) opposing the hollow portion 3*a* of the swing shaft 3. A ball spline 27 is fitted and fixed in the inner circumferential surface of the end portion of the swing shaft 3. The rod 25 is movable in the axial direction of the swing shaft 3 with respect to the ball spline 27 and rotatable together with the ball spline 27. As the rod 25 is disposed in the hollow portion 3*a* of the swing shaft 3, the space is effectively utilized, thereby downsizing the apparatus. The slide member 26 is slidably supported by a guide shaft 29 through slide bearings 30. A pair of rollers 31 are pivotally supported by the lower end of the slide member 26. The guide shaft 29, along which the slide member 26 slides, extends between a pair of brackets 28 fixed to the swing shaft 3 with screws, to be parallel to the swing shaft 3. The pair of cam plates 32 are fixed to the levers 14 with screws and have cam surfaces 32*a*. The cam surfaces 32*a* are inclined so that when the rollers 31 are abutted against the cam surfaces 32*a* and come close to the end portion side of the swing shaft 3 where the cam member 18 is provided, the rollers 31 come close to the swing shaft 3.

The paper conveying operation of the paper conveying apparatus having the above arrangement will be described. The outline of the conventionally known paper conveying operation will be simply described with reference to FIG. 2. Sheets 35 are drawn and conveyed by suction one by one from a paper feed unit by the suction port of a sucker unit. Each sheet is then fed onto a feeder board by rotation of a paper feed roller, and conveyed on the feeder board by a paper feed tape or the like toward a feed board 36. When the sheet 35 is fed onto the feed board 36, its leading end is aligned at a point a serving as a registration portion, and the sheet is gripped by the grippers 8 of the swing unit 1 and the gripper pad 17. As the swing unit 1 is pivoted about the swing shaft 3 as the center, the sheet is conveyed to a point b on the circumferential surface of a cylinder 37. Then, the sheet is re-gripped by the grippers of the cylinder 37.

The operation for correcting fan-out registration, which is the characteristic feature of the present invention, will be described. First, as the swing shaft 3 is restored by the motor to pivot to swing the bearing 12 from the position of the point b to the position of the point a, the support levers 5 fixed to the swing shaft 3 and the gripper shaft 6 fixed to the support levers 5 also swing. Furthermore, the lever 9 fixed to the gripper shaft 6 also swings. The roller 10 supported by the lever 9 is abutted against the cam portion of the cam 11 to pivot the gripper shaft 6 to the registration portion of the feed board 36 against the biasing force of springs (not shown). Then, the sheet 35 whose leading end is aligned at the registration point a of the feed board 36 is gripped by the grippers 8 and the gripper pad 17. When the swing shaft 3 is pivoted, the rod 25 is also pivoted through the ball spline 27, and the lever 23 fixed to the rod 25 is pivoted. The roller 24 is abutted against the end face cam portion 18*a* and rides on it. Therefore, the lever 23 is moved in a direction of an arrow A in FIG. 1 to extract the rod 25 from the hollow portion 3a of the swing shaft 3.

When the rod 25 is moved, the slide member 26 is also moved along the guide shaft 29 in the direction of the arrow A, and the rollers 31 pivotally supported by the slide member 26 rotate along the inclined surfaces of the cam surfaces 32*a* of the cam plates 32. Due to the rolling movement of the rollers 31 along the inclined surfaces of the cam surfaces 32*a*, the cam plates 32 are pushed downward by the rollers 31, and the levers 14 to which the cam plates 32 are mounted are also pushed downward and pivoted slightly. Then, only the central portion of the gripper pad 17 fixed to the lower end portions of the levers 14 and the central portion of the gripper shaft 6 inserted in the lower end portions of the levers 14 flex clockwise about the swing shaft 3 in FIG. 3 as the center. As a result, the alignment positions of the grippers 8 mounted to the gripper shaft 6 are shifted by $\alpha$ as indicated by a chain double-dashed line.

Figure 2:
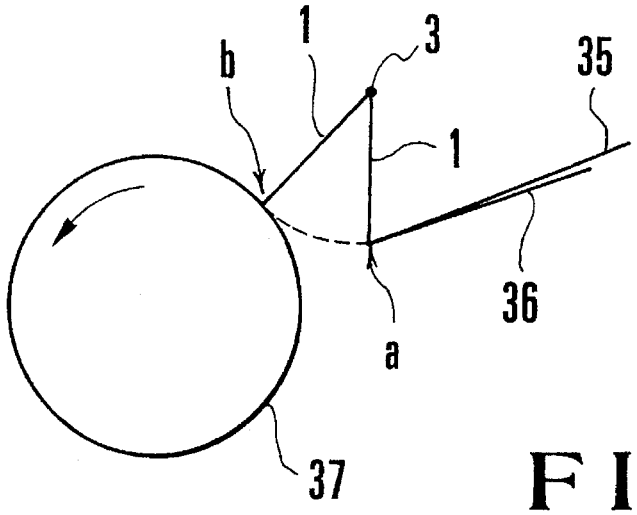
FIG. 2 is a view explaining the paper conveying operation of the paper conveying apparatus shown in FIG. 1.

Therefore, when the grippers 8 of the swing unit 1 grip a sheet 35 at the position of the point a in FIG. 2, i.e., at the position of the registration portion of the feed board 36, some of the plurality of grippers 8 provided to the gripper shaft 6 at the central portion are moved backward by $\alpha$ from the registration portion than those at the two sides, and the grippers 8 are arcuatedly aligned. When the swing shaft 3 is pivoted and the swing unit 1 swings from the position of the point a to the position of the point b shown in FIG. 2, the lever 23 is pivoted through the rod 25 in accordance with the reverse movement to that described above. When the roller 24 is released from the end face cam portion 18*a* of the cam member 18, the lever 23 is moved in a direction of an arrow B in FIG. 1 to move the rod 25 in an inserting direction into the hollow portion 3*a* of the swing shaft 3, thereby moving the slide member 26 in the direction of the arrow B.

When the slide member 26 is moved in the direction of the arrow B, the pressure applied to the cam surfaces 32*a* of the cam plates 32 by the rollers 31 is released, and the pivotal movement of the levers 14 against the compression springs 15a is canceled, so that both the gripper pad 17 and all the grippers 8 are aligned on a straight line indicated by a solid line Y in FIG. 5. For this reason, the grippers 8 at the central portion are moved to pull the two end portions of the sheet 35 with the grippers 8 at the two end sides, thereby stretching the trailing side of the paper. Even if the trailing side of the paper expands or shrinks in the right-to-left direction, the trailing side of the paper is stretched before re-gripping to compensate for the expansion or shrinkage, thereby correcting the fan-out registration.

When the cam member 18 is supported by the end portion of the swing shaft 3, as in this embodiment, in a special movement of the swing shaft 3, for example, this movement can be applied to an eccentric movement of the swing shaft 3 with respect to the frames 2. In this embodiment, a so-called "cam closing method" is employed wherein, during gripping, the grippers are closed by the cams, and during re-gripping, the grippers are opened by the biasing force of the springs. According to this method, during gripping, the gripper shaft 6 flexes. However, since the grippers are forcibly closed by the cams, erroneous gripping caused when the grippers are not closed can be prevented. Also, since the flex disappears during re-gripping, the biasing force of the springs normally acts, thereby smoothly performing re-gripping.

Assume that the flexing amount of the levers 14 is to be adjusted in accordance with a change in expansion or shrinkage amount of the trailing side of the paper. In this case, the adjustment knob 22 is pivoted to pivot the cam member 18 in a direction C or D, as shown in FIG. 4A, to change the phase of the end face cam portion 18*a* of the cam member 18 with respect to the roller 24 by β, as shown in FIG. 4B, thereby changing the ride amount of the roller 24 with respect to the end face cam portion 18*a* by γ, so that the moving amount of the rod 25 is changed. When the adjustment knob 22 mounted to one frame 2 is pivoted in this manner, the pivot amount of the levers 14 is adjusted, thereby changing the flex amount of the gripper shaft 6 and the gripper pad 17. Since adjustment can be performed during operation without stopping the printing press, the productivity is increased. Since adjustment can be performed while performing registration, precise adjustment can be performed.

In the above embodiment, the cam member 18 is pivotally supported by the swing shaft 3. However, the cam member 18 can be pivotally supported by the frame 2, as a matter of course. The adjustment knob 22 need not be manually moved. The adjustment knob 22 may be driven by a motor. Reciprocal movement of the rod 25 is performed by the end face cam portion 18*a* of the cam member 18 and the roller 24. However, it can be performed by an actuator, e.g., an air cylinder.

Figure 6:
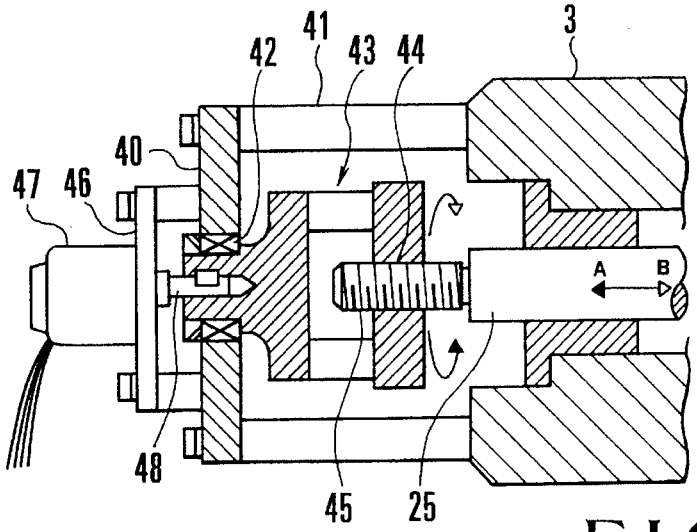
FIG. 6 is a side view showing the main part of a paper conveying apparatus for a sheet-fed press according to the second embodiment of the present invention.

FIG. 6 shows the main part of the second embodiment of the present invention. Portions not shown in FIG. 6 are identical to those of FIGS. 1 to 5, so that those of FIGS. 1 to 5 are applied to this embodiment, and a detailed description thereof will be omitted. Referring to FIG. 6, through spacer members 41, a support plate 40 is mounted parallel to the end face of a swing shaft 3 where a hollow portion 3*a* is open. A rotating member 43 is disposed in a space defined between the end face of the swing shaft 3 and the support plate 40 to be rotatably mounted to the support plate 40 through a bearing 42. The movement of the rotating member 43 in the axial direction is regulated. A female thread portion 44 threadably engageable with a screw body 45 formed at one end of a rod 25 projecting from the hollow portion 3a is formed at one end side of the rotating member 43 opposing the end face of the swing shaft 3. A motor 47 is mounted to the front surface side of the support plate 40 through a bracket 46. A shaft 48 of the motor 47 rotates together with the rotating member 43.

In this arrangement, when the motor 47 is rotated in the forward and reverse directions in accordance with the swing movement of the swing shaft 3, the rotating member 43 is rotated clockwise and counterclockwise, and the screw body 45 threadably engaged with the female thread portion 44 of the rotating member 43 is reciprocally moved in the axial direction. The rod 25 is also reciprocally moved in directions of arrows A and B by the reciprocal movement of the screw body 45, so that rollers 31 of a slide member 26 urge cam plates 32, in the same manner as in the first embodiment. When a sheet 35 is gripped with grippers 8 at a point a shown in FIG. 2, a gripper shaft 6 and a gripper pad 17 flex, thereby providing the same operation and effect as in the first embodiment. Since the motor 47 is employed as the driving source in this manner, the rotating member 43 can be controlled at a timing independently of the movement of a swing unit 1, so that the movement of the swing unit 1 body is not adversely affected. The flexing amount of the gripper shaft 6 and the gripper pad 17 can be easily adjusted by adjusting the feed amount of the rod 25 by a switch (not shown) that controls the motor 47.

In each embodiment described above, the rod 25 is disposed in the hollow portion 3*a* of the swing shaft 3. However, the present invention is not limited to this, and a rod 25 may be disposed at any portion of the empty space, as a matter of course. The slide member 26 and the rollers 31 are reciprocally moved. However, the present invention is not limited to this, and cam plates 32 may be reciprocally moved, as a matter of course. Furthermore, cam plates 32 can be provided at a slide member 26 side, and rollers 31 can be provided to levers 14.

The each embodiment described above has exemplified a case wherein the present invention is applied to the swing unit 1 as a paper conveying apparatus. However, the present invention is not limited to this, and can be applied to the rotating member of a paper convey cylinder, e.g., a paper feed cylinder or a transfer cylinder.

As has been described above, according to the present invention, the gripper pad and the gripper shaft are flexed by a displacing means when a sheet is gripped, and the flexure is restored when the sheet is re-gripped. Therefore, even if the trailing side of the paper is expanded or shrunk in the right-to-left direction, the trailing side of the paper is stretched until re-gripping to correct this expansion or shrinkage, thereby correcting the fan-out registration.

Furthermore, according to the present invention, since the positions of the engaging member and the engaged member, both constituting the converting member, relative to each other are changed by the adjusting means, adjustment can be performed during operation without stopping the printing press. Thus, the productivity can be increased, and precise adjustment is enabled.

What is claimed is:

1. A paper conveying apparatus for a sheet-fed press, comprising:

a shaft having two ends pivotally supported by a pair of frames;

a gripper shaft supported by the shaft which extends parallel to said shaft and swings upon pivotal movement of said shaft;

a plurality of grippers aligned on said gripper shaft;

a gripper pad supported by the shaft which extends to be parallel to said gripper shaft and swings upon pivotal movement of said shaft;

said grippers and said gripper pad gripping and end portion of a sheet, which is conveyed from upstream a paper conveying direction, by cooperation thereof and conveying the sheet to a cylinder dowmstream the paper conveying direction; and displacing means which reciprocally move in an axial direction of said shaft to flex central portions of said gripper pad and said gripper shaft in the paper conveying direction.

2. An apparatus according to claim 1, further comprising a pair of support levers, fixed to said shaft, for pivotally supporting two ends of said gripper shaft and fixing and supporting two ends of said gripper pad, and wherein said displacing means is constituted by a pivot member, pivotally supported by said shaft and coupled to substantially central portions of said gripper pad and said gripper shaft each having two ends respectively supported by said support levers, a movable member provided to be reciprocally movable in the axial direction of said shaft, and a converting member for flexing said central portions of said gripper shaft and said gripper pad by converting reciprocal movement of said movable member into pivotal movement of said pivot member.

3. An apparatus according to claim 2, wherein said converting member is constituted by a first engaging member disposed on said movable member and a first engaged member disposed on said pivot member to be engageable with said first engaging member, one of said first engaging and engaged members having an inclined surface inclined in a pivotal direction of said pivot member to engage with the other one of said first engaging and engaged members, and said pivot member being biased by a biasing means in such a direction that said first engaging member is abutted against said first engaged member, and said first engaging member urges said first engaged member upon reciprocal movement of said movable member, thereby slightly pivoting said pivot member against a biasing force produced by the biasing means.

4. An apparatus according to claim 3, wherein said pivot member is constituted by a pair of pivot levers disposed at a substantially central portion of said shaft with a predetermined gap therebetween, said first engaging member is constituted by a pair of rollers parallel to the moving direction of said movable member, and said first engaged member is constituted by a pair of cam plates disposed on said pivot levers to correspond to said rollers.

5. An apparatus according to claim 2, further comprising driving means for reciprocally driving said movable member.

6. An apparatus according to claim 5, wherein said shaft is cylindrically formed and has a hollow portion, and said movable member includes a rod which is housed in the hollow portion of said shaft, which has one end coupled to said converting member and the other end opposing an opening of an end face of said shaft, wherein said rod is reciprocally driven in the axial direction of said shaft by the driving means.

7. An apparatus according to claim 6, wherein said driving means is constituted by a second engaging member which pivots in an interlocked manner with pivotal movement of said shaft and a second engaged member which is provided to said movable member to engage with said second engaging member, one of said second engaging and engaged members having an inclined surface inclined in a moving direction of said movable member to engage with the other one of said second engaging and engaged members, and said second engaging member urging said second engaged member upon pivotal movement of said shaft to reciprocally move said movable member.

8. An apparatus according to claim 7, further comprising adjusting means which changes phases of said second engaging and engaged members relative to each other to change a pivot amount, of said pivot members, converted from the moving amount of said movable member along said inclined surface, thereby adjusting flex amounts of said gripper shaft and said gripper pad.

9. An apparatus according to claim 5, wherein said driving means is constituted by a screw member coupled to said movable member so as to reciprocally move integrally with said movable member in the moving direction of said movable member and a rotating member pivotally supported by said shaft as not to move in the axis direction of said shaft, and a motor for rotating said rotating member by rotation of said motor in forward and reverse directions.

10. An apparatus according to claim 9, wherein a moving amount of said movable member is changed by controlling a rotation amount of said motor, thereby adjusting the flex amounts of said gripper shaft and said gripper pad.

* * * * *